US005746140A

United States Patent [19]

Flood

[11] Patent Number: 5,746,140

[45] Date of Patent: May 5, 1998

[54] SECURITY CONTAINER

[75] Inventor: Dennis Flood, Dundee, Scotland

[73] Assignee: NCR Corporation, Dayton, Ohio

[21] Appl. No.: 778,343

[22] Filed: Jan. 2, 1997

[30] Foreign Application Priority Data

Aug. 29, 1996 [GB] United Kingdom ..... 9618068

[51] Int. Cl.[6] ..... E05G 1/04

[52] U.S. Cl. ..... 109/50; 109/51

[58] Field of Search ..... 109/50–52, 78, 109/79, 87; 248/551; 900/30, 33

[56] References Cited

U.S. PATENT DOCUMENTS

| | | | |
|---|---|---|---|
| 674,145 | 5/1901 | Weissenborn | 109/50 X |
| 2,465,057 | 3/1949 | Brandes | 109/51 |
| 3,741,132 | 6/1973 | Blower | 109/50 X |
| 4,051,790 | 10/1977 | Meditz | 109/52 X |
| 4,123,978 | 11/1978 | Lentini | 109/51 |
| 4,258,632 | 3/1981 | LaPointe | 109/52 X |
| 4,425,687 | 1/1984 | Serra | 109/50 |
| 4,438,606 | 3/1984 | Chardon et al. | 109/50 X |
| 5,199,361 | 4/1993 | Robinson | 109/50 X |
| 5,488,914 | 2/1996 | Ouellette | 109/50 X |
| 5,513,580 | 5/1996 | Franks | 109/51 |

FOREIGN PATENT DOCUMENTS

| | | | |
|---|---|---|---|
| 145846 | 4/1903 | Germany | 109/51 |
| 3815910 | 11/1989 | Germany | 709/50 |
| 162498 | 5/1921 | United Kingdom | 109/52 |
| 2039599 | 8/1980 | United Kingdom | 109/50 |

*Primary Examiner*—Suzanne Dino
*Attorney, Agent, or Firm*—Michael Chan

[57] ABSTRACT

A safe, for example for an automated teller machine, (90) comprises a steel body (10) of open-floor construction and having horizontal mounting bars (22,24,26) welded to the inside of the body walls (12,14,16); either a detachable steel floor (30) or an open-top steel container (40) can be attached to the mounting bars by bolts (23) accessible only from inside the container. The volume of the safe can therefore be increased by an on-site modification to allow an additional cassette (102) to be provided.

6 Claims, 3 Drawing Sheets

FIG. 2(a)
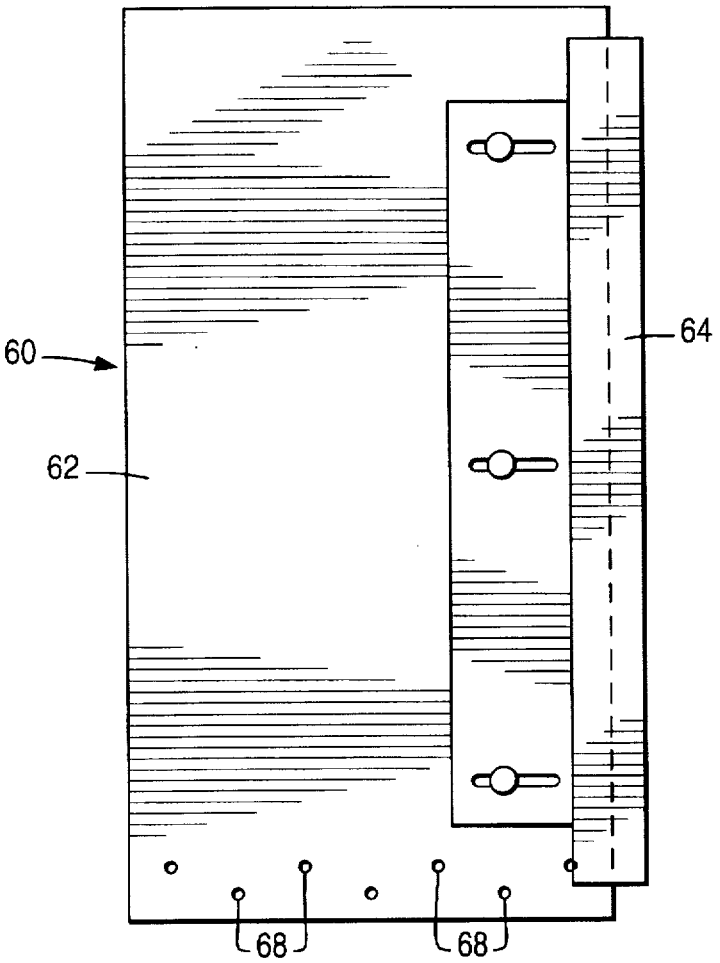
FIG. 2(b)
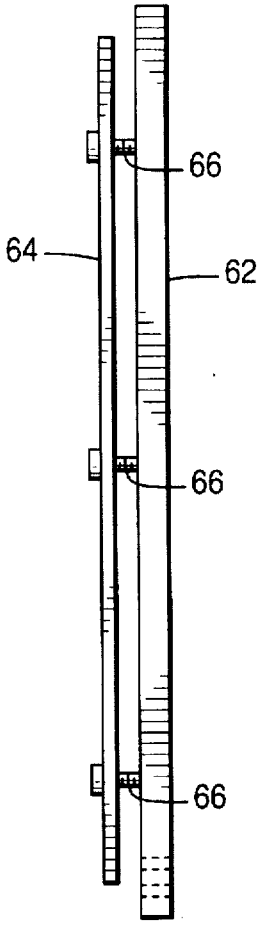
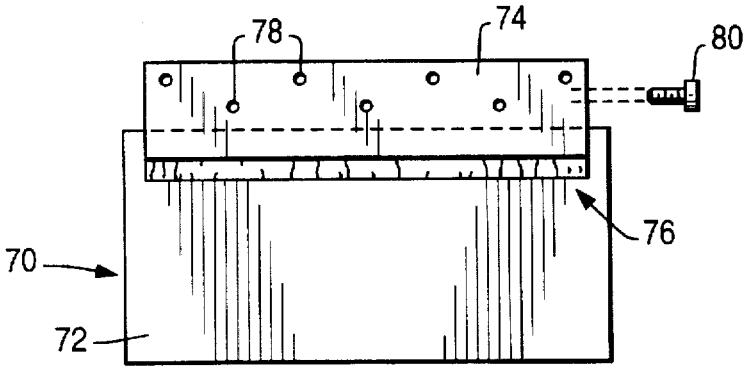
FIG. 2(c)
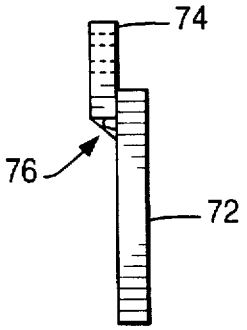
FIG. 2(d)

SECURITY CONTAINER

BACKGROUND OF THE INVENTION

This invention relates to a security container, which may be a safe for an automated teller machine (ATM) which dispenses and/or receives cash, or a conventional safe.

When an ATM is installed by a financial institution such as a bank, it is natural to use the smallest size of ATM considered likely to provide a required level of service. Often this will be an ATM having a single currency cassette for dispensing cash. Every ATM incorporates a security container or safe, which is also of the smallest required size.

After installation, a financial institution may find that the demand is greater than expected, requiring two or more currency cassettes to meet the demand for cash withdrawals without over-frequent servicing, or may find that there is a different, unmet demand, such as the need to deposit cash as well as withdraw it.

If the financial institution wishes to provide an additional cassette, the only current option is to replace the entire ATM, as the installed security container is not sufficiently large to permit the provision of a second or further cassette, so no upgrade is therefore possible.

The safe in an ATM is of a similar construction to a conventional safe, i.e. a welded steel container with a hinged door.

SUMMARY OF THE INVENTION

It is an object of the invention to provide a security container capable of being increased in volume with minimum inconvenience.

According to a first aspect of the invention there is provided a security container comprising a steel body and a hinged door characterized by the container being of open-floor construction and having a detachable container floor portion securable to mounting means on the inside walls of the container by securing means accessible only from inside the container.

According to a second aspect of the invention there is provided a security container comprising a steel body and a hinged door characterized by:

the body being of open-floor construction and having mounting means on the inside walls of the container; and a secure extension below the body, the extension comprising an open-top steel container having around the inside of the upper edges of the container fixing means securable to the mounting means by securing means accessible only from inside the container.

BRIEF DESCRIPTION OF THE DRAWINGS

The invention will now be described by way of example only, with reference to the accompanying drawings in which:

FIGS. 2(*a*) and 2(*b*) show a rear view and edge view of a door for a security container, and FIGS. 2(*c*) and 2(*d*) shows similar views of a secure extension for such a door.

DETAILED DESCRIPTION

Figure 1A:
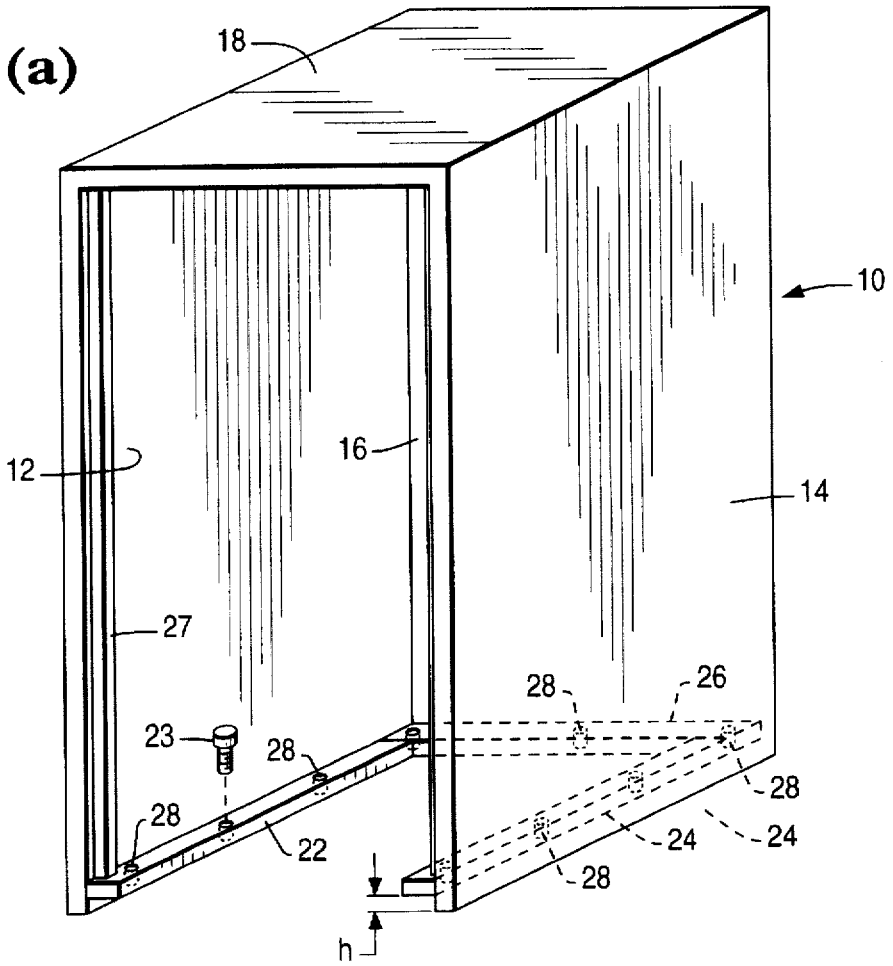
FIG. 1(*a*) is a view of a security container according to the invention, provided with either a detachable floor as illustrated in FIG. 1(*b*) or a secure extension as illustrated in FIG. 1(*c*)
Figure 1B:
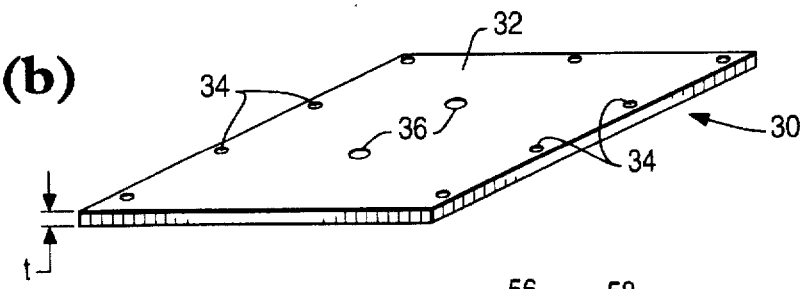
Figure 1C:
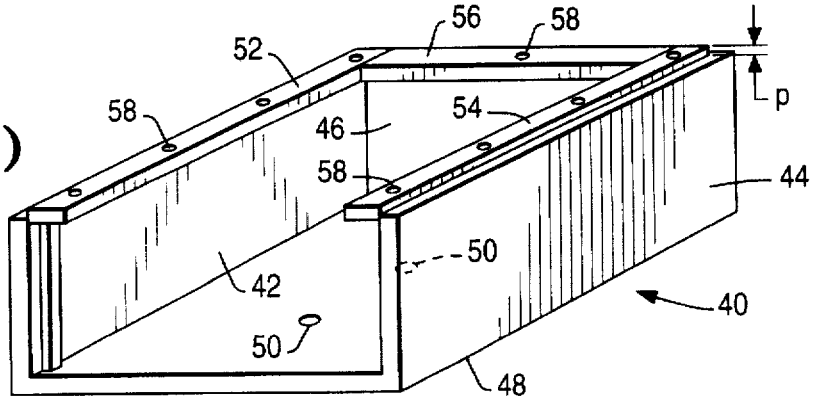

In FIG. 1(*a*) a security container comprises a welded steel body 10 having sidewalls 12, 14, a rear wall 16 and a roof 18. Around the inside of the walls, placed horizontally close to their lower edges, are three steel mounting bars 22, 24, 26 of rectangular cross section. The bars are welded to the container walls, and each bar is pierced by a number of vertical clearance holes 28.

Referring now to FIG. 1(*b*), a detachable container floor 30 comprises a flat steel plate 32 of such dimensions as just to fit within the sidewalls 12, 14 and rear wall 16 of the container body 10. The plate 32 is provided on its upper surface with blind threaded holes 34 around three edges, the holes being spaced to match the clearance holes 28 in the mounting bars 22, 24, 26.

The container floor 30 can be bolted to the container body 10 by securing bolts, such as bolt 23 shown in FIG. 1 (*a*), passing through the clearance holes 28 in the mounting bars 22, 24, 26 into the threaded holes 34 in the plate 32.

It will be clear that the bolts 23 can be accessed only from the inside of the container body 10. Since the threaded holes 34 are blind, there is no easy access even if the container body 10 is jacked up or tilted. To further improve security, each threaded hole may contain a hard ball bearing (not shown) between its blind end and its bolt to yet further hinder access to the securing bolts 23 from below.

The thickness t of the plate 32 is selected to equal the height h of the mounting bars 22, 24, 26 above the lower edges of the walls 14, 16, 18. The floor plate 32 then fits flush with the wall edges, making it yet more difficult to jack up or tilt the machine.

The plate 32 is provided with anchoring holes 36 to anchor the whole container to the floor by anchoring bolts (not shown), giving further security against movement of the container.

Referring now to FIG. 1(*c*), a security extension 40 comprises an open-topped welded steel box having sidewalls 42, 44, rear wall 46, and floor 48. The floor is provided with anchoring holes 50 identical to the anchoring holes 36 in the detachable floor 30.

Around the inside of the walls 42, 44, 46, placed horizontally, are three steel fixing bars 52, 54, 56, of rectangular cross section. The bars are welded to the container walls, and each bar is pierced by a number of blind threaded holes 58 corresponding to the clearance holes 28 shown in FIG. 1(*a*).

The bars 52, 54, 56 project above the upper edges of the walls 42, 44, 46 by a distance p which equals the height h shown in FIG. 1(*a*).

If the detachable container floor 30 is unbolted from the container 10, and is replaced by the secure extension 40, bolted by bolts 23 accessible only from inside the container, the secure volume has been increased without substantially reducing the security level.

Referring again to FIG. 1(*a*), the sidewalls 12 and 14 are provided with vertical welded rebate bars (only one bar 27 being shown) which carry part of the locking mechanism for the door (not shown).

When the extension 40 is positioned below the container 10, the door must also be extended, as shown in FIG. 2.

In FIGS. 2(*a*) and 2(*b*) a steel door 60 is shown as if viewed from inside the security container 10. The door comprises a vertical steel plate 62 carrying adjacent one vertical edge a conventional locking blade 64, attached to the plate 62 by three fixing means 66.

The lower edge of the door is provided with a number of blind threaded holes 68.

Referring now to FIG. 2(*c*) and 2(*d*), a door extension 70 comprises a vertical steel extension plate 72 having a steel mounting plate 74 welded at 76 to its upper edge. The mounting plate 74 is pierced by a number of mounting holes 78 which match the positions of the threaded holes 68 in the door 60 in FIG. 2(*a*).

When the extension 70 to the door is required, the mounting plate 74 is bolted by bolts (not shown) through holes 78 into threaded holes 68. It will be clear that the bolts are accessible only when the door 60 is open. Further, the operation of the locking blade 64 is unaffected.

The principle of extending the secure volume of a safe illustrated in FIGS. 1 and 2 can be applied to a conventional safe, or to the safe in an ATM, allowing the addition of a second or further currency cassette. Upgrading of an ATM is therefore relatively easy, providing only that sufficient room is available to extend the safe by the volume of the extension. The upgrade can be carried out on site by a service engineer.

Figure 3:
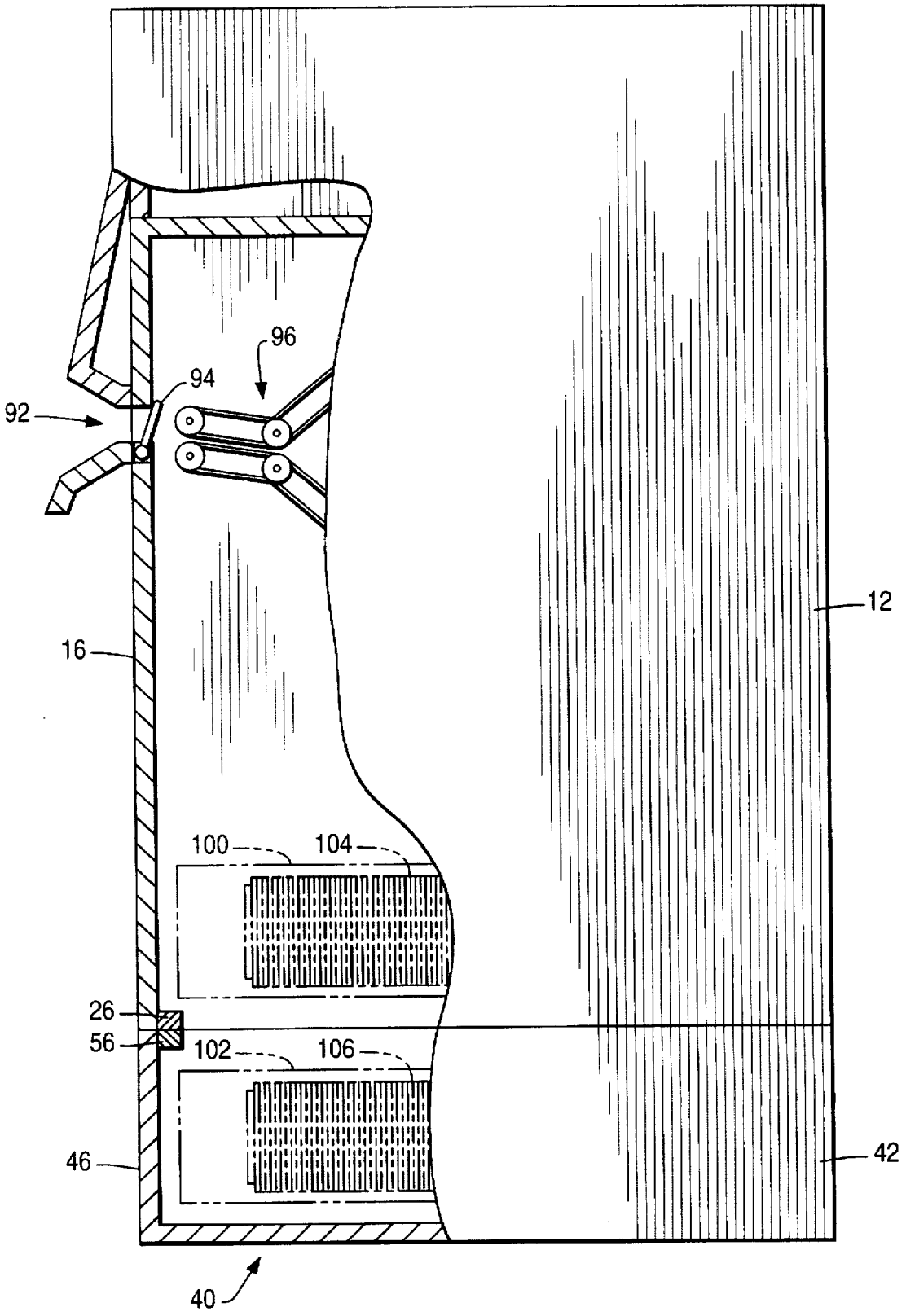
FIG. 3 shows a vertical part section of an ATM having a safe according to the invention.

An ATM 90 incorporating a safe according to the invention is shown in FIG. 3. The ATM has a currency delivery slot 92 backed by a shutter 94 and adjacent a currency delivery mechanism 96. The slot 92 is formed in the rear wall 16 of the safe shown in FIG. 1, so that side walls 12, 42 of the safe and the extension are visible.

Within the ATM are upper and lower currency cassettes 100, 102 containing respective stacks of currency 104, 106. The upper cassette 100 is located just above the steel mounting bar 26 carried by the rear wall 16, and initially cassette 100 would be the only cassette in the ATM and would rest on the detachable container floor, reference 30 in FIG. 1. When a second cassette 102 is required, the floor is removed and replaced by the security extension 40, with the fixing bar 56 on the wall 46 being attached to the mounting bar 26.

In operation, the ATM 90 can deliver currency from either a single cassette 100, or from both cassettes 100, 102, to the currency delivery slot 92.

Typically the container 10 and extension 40 will be made of ½ inch toughened steel (10,000 PSI tensile), and the detachable floor 30 may be of ½ inch toughened steel or of 1 inch mild steel. Typically the mounting bars 22, 24, 26 and fixing bars 52, 54, 56 will be 1 inch×½ inch steel bars.

An ATM security container in accordance with the invention and using the above-mentioned materials and thicknesses is capable of meeting the test requirements of the Underwriters Laboratories, Northbrook, Ill. for a UL 291 Level 1 safe label that is, the container can withstand an 8 minute equivalency test using common mechanical tools on the joint between the container body and either the detachable floor or the secure extension. It is believed that the relevant European CEN safe and ATM standards will also be met.

What is claimed is:

1. An apparatus comprising:

a first steel body of open-floor construction and including a number of wall portions having a number of lower edges and a number of inside wall surfaces which defines at least in part an inside space;

mounting bars disposed on the inside wall surfaces of the wall portions of the first steel body;

a second steel body of open-top construction and including a number of wall portions having a number of upper edges which defines at least in part an inside space;

fixing bars disposed on the upper edges of the wall portions of the second steel body and connectable to the mounting bars such that the first and second steel bodies form a security container when the fixing bars and the mounting bars are connected;

a detachable floor interchangeable with the second steel body and connectable to the mounting bars such that the detachable floor and the first steel body form a security container when the detachable floor and the mounting bars are connected; and securing means for securing either the detachable floor or the fixing bars of the second steel body to the mounting bars of the first steel body to form a security container, the securing means being accessible only from either the inside space of the first steel body or the inside space of the second steel body.

2. A security container comprising:

a steel body of open-floor construction and including a number of wall portions having a number of inside wall surfaces which defines at least in part an inside space;

a door hingedly connected to a wall portion of the body;

mounting means disposed on the inside wall surfaces of the wall portions of the body, the mounting means including horizontal mounting bars welded to the wall portions of the body;

a detachable floor; and securing means for securing the detachable floor to the inside wall surfaces of the wall portions of the body, the securing means being accessible only from the inside space of the body.

3. A security container according to claim 2, wherein the securing means includes bolts cooperable with apertures in the mounting bars and threaded apertures in the detachable floor.

4. A security container according to claim 3, wherein (i) the wall portions have a lower edge, and (ii) the horizontal mounting bars are spaced above the lower edge of the wall portions by a height equal to a thickness of the floor.

5. A security container comprising:

a first steel body of open-floor construction and including a number of wall portions having a number of lower edges and a number of inside wall surfaces which defines at least in part an inside space;

a first door hingedly connected to a wall portion of the first steel body;

mounting bars disposed on the inside wall surfaces of the wall portions of the first steel body;

a second steel body of open-top construction and including a number of wall portions having a number of upper edges which defines at least in part an inside space;

fixing bars disposed on the upper edges of the wall portions of the second steel body; and body securing means for securing the fixing bars to the mounting bars to secure the first and second steel bodies together, the securing means being accessible only from either the inside space of the first steel body and/or the inside space of the second steel body;

the fixing bars and the mounting bars being horizontal, the horizontal fixing bars projecting above the upper edges of the wall portions of the second steel body by a distance equal to a height of the horizontal mounting bars above the lower edges of the wall portions of the first steel body.

6. A security container comprising:

a first steel body of open-floor construction and including a number of wall portions having a number of lower edges and a number of inside wall surfaces which defines at least in part an inside space;

a first door hingedly connected to a wall portion of the first steel body;

mounting bars disposed on the inside wall surfaces of the wall portions of the first steel body;

a second steel body of open-top construction and including a number of wall portions having a number of upper edges which defines at least in part an inside space;

fixing bars disposed on the upper edges of the wall portions of the second steel body;

body securing means for securing the fixing bars to the mounting bars to secure the first and second steel bodies together, the securing means being accessible only from either the inside space of the first steel body and/or the inside space of the second steel body;

a second door associated with the second steel body;

a mounting plate welded to the second door; and door securing means for securing the second door to the first door, the door securing means being accessible only when the first door is open.

* * * * *